US006805124B2

(12) United States Patent
Japuntich et al.

(10) Patent No.: US 6,805,124 B2
(45) **Date of Patent: *Oct. 19, 2004**

(54) FACE MASK THAT HAS A FILTERED EXHALATION VALVE

(75) Inventors: Daniel A. Japuntich, St. Paul, MN (US); Nicole V. McCullough, St. Paul, MN (US); Jane K. Peterson, Eagan, MN (US); Nicholas R. Baumann, St. Paul, MN (US); John W. Bryant, High Shincliffe (GB); Christopher P. Henderson, Durham (GB); Bruce E. Penning, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/217,072

(22) Filed: Aug. 12, 2002

(65) Prior Publication Data

US 2003/0005934 A1 Jan. 9, 2003

Related U.S. Application Data

(63) Continuation of application No. 09/122,388, filed on Jul. 24, 1998, now Pat. No. 6,584,976.

(51) Int. Cl.[7] ..... A62B 18/08; A62B 19/00; A62B 18/02; A62B 23/02

(52) U.S. Cl. ..... 128/206.15; 128/201.25; 128/205.25; 128/205.27; 128/205.29

(58) Field of Search ..... 128/201.23, 201.25, 128/201.28, 201.29, 205.24, 205.25, 205.27, 205.29, 206.21, 206.15, 206.17, 206.18, 206.19, 206.28, 207.12, 207.13, 206.12

(56) References Cited

U.S. PATENT DOCUMENTS

| | | | |
|---|---|---|---|
| 896,447 | A | 8/1908 | Hall et al. |
| 1,013,541 | A | 1/1912 | Fleuss et al. |

(List continued on next page.)

FOREIGN PATENT DOCUMENTS

| | | |
|---|---|---|
| DE | 666367 | 10/1938 |
| DE | 43 07 754 A1 | 4/1994 |

(List continued on next page.)

OTHER PUBLICATIONS

Australian Standard® Surgical Face Masks (AS 4381 – 1996).

(List continued on next page.)

*Primary Examiner*—Henry Bennett
*Assistant Examiner*—Joseph Weiss
(74) *Attorney, Agent, or Firm*—Karl G. Hanson

(57) ABSTRACT

A filtering face mask that covers at least the nose and mouth of a wearer and that includes an exhalation valve. The exhalation valve opens in response to increased pressure when the wearer exhales to allow the exhaled air to be rapidly purged from the mask interior. An exhale filter element may be placed in one of several locations in the exhale flow stream to remove contaminants from the exhaled air. The face mask is beneficial in that it provides comfort to the wearer by allowing warm, moist, high-$CO_2$-content air to be rapidly evacuated from the mask interior through the valve and also protects the wearer from splash fluids and polluted air while at the same time protecting other persons or things from being exposed to contaminants in the exhale flow stream.

72 Claims, 7 Drawing Sheets

U.S. PATENT DOCUMENTS

| | | | | | |
|---|---|---|---|---|---|
| 1,625,419 | A | | 4/1927 | McCaa | |
| 1,925,764 | A | | 9/1933 | Le Duc | |
| 2,111,995 | A | | 3/1938 | Schwartz | |
| 2,284,949 | A | | 6/1942 | Cover | |
| 2,435,721 | A | | 2/1948 | Lehmann | |
| 2,744,525 | A | | 5/1956 | Whipple | |
| 2,898,908 | A | | 8/1959 | Sovinsky | |
| 2,983,271 | A | | 5/1961 | Beck | |
| 3,473,165 | A | | 10/1969 | Gran et al. | |
| 3,550,588 | A | | 12/1970 | Stahl | |
| 3,565,068 | A | | 2/1971 | Bickford | |
| 3,575,167 | A | | 4/1971 | Michielsen | |
| 3,603,313 | A | | 9/1971 | Arblaster | |
| 3,971,369 | A | | 7/1976 | Aspelin et al. | |
| 4,141,703 | A | | 2/1979 | Mulchi | |
| 4,215,682 | A | | 8/1980 | Kubik et al. | |
| 4,231,364 | A | | 11/1980 | Speshyock | |
| 4,411,023 | A | | 10/1983 | Pinson | |
| 4,414,973 | A | | 11/1983 | Matheson et al. | |
| 4,454,881 | A | | 6/1984 | Huber et al. | |
| 4,537,189 | A | | 8/1985 | Vicenzi | |
| 4,549,543 | A | | 10/1985 | Moon | |
| 4,558,708 | A | | 12/1985 | Labuda et al. | |
| 4,598,704 | A | | 7/1986 | Bordoni et al. | |
| 4,763,645 | A | | 8/1988 | Kapp | |
| 4,765,325 | A | | 8/1988 | Crutchfield | |
| 4,774,942 | A | | 10/1988 | Moellers | |
| 4,793,342 | A | | 12/1988 | Haber et al. | |
| 4,813,948 | A | | 3/1989 | Insley | |
| 4,827,924 | A | | 5/1989 | Japuntich | |
| 4,850,346 | A | | 7/1989 | Michel et al. | |
| 4,873,972 | A | | 10/1989 | Magidson et al. | |
| 4,874,399 | A | * | 10/1989 | Reed et al. | 95/57 |
| 4,901,716 | A | | 2/1990 | Stackhouse et al. | |
| 4,921,645 | A | | 5/1990 | Insley | |
| 4,926,855 | A | | 5/1990 | Hellquist et al. | |
| 4,934,362 | A | | 6/1990 | Braun | |
| 5,016,625 | A | | 5/1991 | Hsu et al. | |
| 5,035,240 | A | | 7/1991 | Braun et al. | |
| 5,036,840 | A | | 8/1991 | Wallace | |
| 5,036,842 | A | | 8/1991 | van der Smissen et al. | |
| 5,062,421 | A | | 11/1991 | Burns et al. | |
| 5,086,768 | A | | 2/1992 | Niemeyer | |
| 5,091,102 | A | | 2/1992 | Sheridan | |
| 5,117,821 | A | | 6/1992 | White | |
| 5,325,892 | A | | 7/1994 | Japuntich et al. | |
| 5,357,947 | A | | 10/1994 | Adler | |
| 5,364,615 | A | | 11/1994 | Debs et al. | |
| 5,366,726 | A | | 11/1994 | Debs et al. | |
| 5,374,458 | A | | 12/1994 | Burgio | |
| 5,479,920 | A | * | 1/1996 | Piper et al. | 128/204.23 |
| 5,505,197 | A | | 4/1996 | Scholey | |
| 5,509,436 | A | | 4/1996 | Japuntich et al. | |
| 5,526,804 | A | | 6/1996 | Ottestad | |
| 5,560,354 | A | | 10/1996 | Berthon-Jones et al. | |
| 5,595,173 | A | | 1/1997 | Dodd, Jr. | |
| 5,597,645 | A | | 1/1997 | Pike et al. | |
| 5,641,555 | A | | 6/1997 | Berrigan et al. | |
| 5,643,507 | A | * | 7/1997 | Berrigan et al. | 264/6 |
| 5,657,752 | A | | 8/1997 | Landis et al. | |
| 5,658,640 | A | | 8/1997 | Berrigan et al. | |
| 5,658,641 | A | | 8/1997 | Berrigan et al. | |
| 5,676,133 | A | | 10/1997 | Hickle et al. | |
| 5,690,949 | A | * | 11/1997 | Weimer et al. | 424/402 |
| 5,697,105 | A | | 12/1997 | White | |
| 5,735,265 | A | | 4/1998 | Flynn | |
| 5,772,884 | A | * | 6/1998 | Tanaka et al. | 210/500.36 |
| 5,834,386 | A | | 11/1998 | Cohen | |
| 5,875,775 | A | * | 3/1999 | Nur et al. | 128/201.28 |
| 5,941,244 | A | | 8/1999 | Yamazaki et al. | |
| 5,983,894 | A | | 11/1999 | Fukunaga et al. | |
| 6,003,511 | A | | 12/1999 | Fukunaga et al. | |
| 6,014,971 | A | * | 1/2000 | Danisch et al. | 128/201.25 |
| 6,041,782 | A | * | 3/2000 | Angadjivand et al. | 128/206.19 |
| 6,250,299 | B1 | | 6/2001 | Danisch et al. | |
| 6,279,572 | B1 | | 8/2001 | Danisch et al. | |
| 6,584,976 | B2 | * | 7/2003 | Japuntich et al. | 128/206.15 |

FOREIGN PATENT DOCUMENTS

| | | | | | |
|---|---|---|---|---|---|
| EP | 0 149 590 | A2 | | 7/1985 | |
| EP | 0 171 551 | A2 | | 2/1986 | |
| EP | 0 281 275 | A2 | | 9/1988 | |
| EP | 0 281 650 | A1 | | 9/1988 | |
| EP | 281-650 | A | * | 9/1988 | 128/200.14 |
| EP | 0 697 225 | A2 | | 2/1996 | |
| FR | 746196 | | | 5/1933 | |
| FR | 857420 | | | 9/1940 | |
| GB | 2233905 | A | | 1/1991 | |

OTHER PUBLICATIONS

Greene, V.W. et al., *Method For Evaluating Effectiveness of Surgical Masks*, Journal of Bacteriology, pp. 663–667 (1962).

Friedrichs, Jr. W.H., *Measuring Face Masks Performance: A Real Test*, Journal of Environmental Sciences, pp. 33–40, vol. 32, No. 6, (Nov./Dec. 1989).

Vesley,. D. et al., *Clinical Implications of Surgical Mask Retention Efficiencies for Viable and Total Particles*, Infections In Surgery, pp. 531–536, 533 (Jul. 1983).

*Proposed Recommended Practice for OR Wearing Apparel*, AORN Journal, v. 33, n. 1, pp. 100–104, 101 (Jan. 1981).

*Guidelines for Preventing the Transmission of Mycobacterium Tuberculosis in Health Care Facilities*, Morbidity and Mortality Weekly Report, U.S. Dept. Health & Human Services, v. 43, n. RR–13, pp. 34 & 98 (Oct. 28, 1994).

*Standards, Recommended Practices, and Guidelines*, Association of Operating Room Nurses, Inc., pp. 144–145 (1997).

*Webster's New International Dictionary of the English Language*, 2 ed. G. & C. Merriam Co. (Apr. 1937).

* cited by examiner

FACE MASK THAT HAS A FILTERED EXHALATION VALVE

This application is a continuation of U.S. Ser. No. 09/122,388 filed Jul. 24, 1998, now U.S. Pat. No. 6,584,976.

The present invention pertains to a face mask that has a filter element associated with an exhalation valve. The filter element allows the face mask to remove contaminants from the exhale flow stream.

BACKGROUND

Face masks that have been designed to protect the wearer are commonly referred to as "respirators", whereas masks that have been designed primarily with the second scenario in mind—namely, to protect other persons and things—are generally referred to as "face masks" or simply "masks".

A surgical mask is a good example of a face mask that frequently does not qualify as a respirator. Some surgical masks are loose fitting face masks, designed primarily to protect other persons from contaminants that are expelled by the wearer. Substances that are expelled from a wearer's mouth are often aerosols, which generally contain suspensions of fine solids or liquid particles in gas. Surgical masks are quite capable of filtering these particles. U.S. Pat. No. 3,613,678 to Mayhew discloses an example of a loose fitting surgical mask.

Masks that do not seal about the face, such as some known surgical masks, typically do not possess an exhalation valve to purge exhaled air from the mask interior. The masks sometimes are loose fitting to allow exhaled air to easily escape from the mask's sides so that the wearer does not feel discomfort, particularly when breathing heavily. Because these masks are loose fitting, however, they may not fully protect the wearer from inhaling contaminants or from being exposed to fluid splashes. In view of the various contaminants that are present in hospitals, and the many pathogens that exist in bodily fluids, the loose-fitting feature is a notable drawback for such surgical masks. Additionally, masks that do not seal about the face are known to allow exhaled breath to pass around the mask edges, known as "blow by", and such masks would not benefit from having an exhalation valve attached to the mask body.

Face masks also have been designed to provide a tighter, more hermetic fit between the wearer's face and the mask. Some tightly fitting masks have a non-porous rubber face piece that supports removable or permanently-attached filter cartridges. The face piece also possesses an exhalation valve to purge warm, humid, high-$CO_2$-content, exhaled air from the mask interior. Masks having this construction are commonly referred to more descriptively as respirators. U.S. Pat. No. 5,062,421 to Bums and Reischel discloses an example of such a mask. Commercially available products include the 5000 and 6000 Series™ masks sold by 3M Company, St. Paul, Minn.

Other tightly fitting face masks have a porous mask body that is shaped and adapted to filter inhaled air. Usually these masks are also referred to as respirators and often possess an exhalation valve, which opens under increased internal air pressure when the wearer exhales—see, for example, U.S. Pat. No. 4,827,924 to Japuntich.

Additional examples of filtering face masks that possess exhalation valves are shown in U.S. Pat. Nos. 5,509,436 and 5,325,892 to Japuntich et. al., U.S. Pat. No. 4,537,189 to Vicenzi, U.S. Pat. No. 4,934,362 to Braun, and U.S. Pat. No. 5,505,197 to Scholey.

Typically, the exhalation valve is protected by a valve cover—see, for example, U.S. Pat. Nos. Des. 347,299 and Des. 347,298—that can protect the valve from physical damage caused, for example, by inadvertent impacts.

Known tightly fitting masks that possess an exhalation valve can prevent the wearer from directly inhaling harmful particles, but the masks have limitations when it comes to protecting other persons or things from being exposed to contaminants expelled by the wearer. When a wearer exhales, the exhalation valve is open to the ambient air, and this temporary opening provides a conduit from the wearer's mouth and nose to the mask exterior. The temporary opening can allow aerosol particles generated by the wearer to pass from the mask interior to the outside. Conversely, projectiles such as splash fluids may pass from outside the mask to its interior through the temporary opening.

In many applications, especially in surgery and clean rooms, the open conduit that the exhalation valve temporarily provides could possibly lead to infection of a patient or contamination of a precision part. The Association of Operating Room Nurses has recommended that masks be 95 percent efficient in retaining expelled viable particles. *Proposed Recommended Practice for OR Wearing Apparel*, AORN JOURNAL, v. 33, n. 1, pp. 100–104, 101 (January 1981); see also D. Vesley et al., *Clinical Implications of Surgical Mask Retention Efficiencies for Viable and Total Particles, INFECTIONS IN SURGERY*, pp. 531–536, 533 (July 1983). Consequently, face masks that employ exhalation valves are not currently recommended for use in such environments. See e.g., *Guidelines for Preventing the Transmission of Mycobacterium Tuberculosis in Health Care Facilities*, MORBIDITY AND MORTALITY WEEKLY REPORT, U.S. Dept. Health & Human Services, v. 43, n. RR-13, pp. 34 & 98 (Oct. 28, 1994).

Face masks have been produced that are able to protect both the wearer and nearby persons or objects from contamination. Commercially available products include the 1800™, 1812™, 1838™, 1860™, and 8210™ brand masks sold by the 3M Company. Other examples of masks of this kind are disclosed in U.S. Pat. Nos. 5,307,706 to Kronzer et al., 4,807,619 to Dyrud, and 4,536,440 to Berg. The masks are relatively tightly fitting to prevent gases and liquid contaminants from entering and exiting the interior of the mask at its perimeter, but the masks commonly lack an exhalation valve that allows exhaled air to be quickly purged from the mask interior. Thus, although the masks remove contaminants from the inhale and exhale flow streams and provide splash fluid protection, the masks are generally unable to maximize wearer comfort.

U.S. Pat. No. 5,117,821 to White discloses an example of a mask that removes odor from exhaled air. This mask is used for hunting purposes to prevent the hunted animal from detecting the hunter. This mask has an inhalation valve that permits ambient air to be drawn into the mask's interior, and it has a purifying canister supported at the wearer's torso for receiving exhaled air. A long tube directs exhaled air to the remote canister. The device has exhalation valves disposed at the canister's ends to control passage of purified breath to the atmosphere and to preclude back inhalation of breath from the canister. The canister may contain charcoal particles to remove breath odors.

Although the hunting mask prevents exhaled organic vapors from being transported to the ambient air (and may provide the hunter with an unfair advantage), the mask is not designed to provide a clean air source to the wearer. Nor does it provide an attachment for an intake filter, and it is somewhat cumbersome and would not be practical for other applications.

SUMMARY OF THE INVENTION

In view of the above, a filtering face mask is needed that can prevent contaminants from passing from the wearer to the ambient air, that can prevent splash fluids from entering the mask interior, and that allows warm, humid, high-$CO_2$-content air to be quickly purged from the mask's interior.

This invention affords such a mask, which in brief summary comprises: (a) a mask body; (b) an exhalation valve that is disposed on the mask body and that has at least one orifice that allows exhaled air to pass from an interior gas space to an exterior gas space during an exhalation; and (c) an exhale filter element that does not also serve as an inhale filter element, that comprises a fibrous filter, and that is disposed in the face mask's exhale flow stream to prevent contaminants from passing from the interior gas space to the exterior gas space with the exhaled air. In one particular embodiment, the exhale filter element is disposed in the exhale flow stream downstream to the valve orifice.

The invention differs from known face masks that possess an exhalation valve in that the invention includes an exhale filter element that can prevent contaminants in the exhale flow stream from passing from the mask's interior gas space to the exterior gas space. This feature allows the face mask to be particularly beneficial for use in surgical procedures or for use in clean rooms where it would not have been used in the past. Also, unlike some previously known face masks, the invention can be in the form of a tightly-fitting mask that provides the wearer with good protection from airborne contaminants and from splash fluids. And because the inventive face mask possesses an exhalation valve, it can furnish the wearer with good comfort by being able to quickly purge warm, humid, high-$CO_2$-content air from the mask interior. Thus, the invention provides increased comfort to wearers by decreasing temperature, moisture, and carbon dioxide levels within the mask, while at the same time protecting the wearer and preventing particles and other contaminants from passing to the ambient environment.

These and other advantages and features that characterize the invention are illustrated below in the detailed description and accompanying drawings.

GLOSSARY

In reference to the invention, the following terms are defined as set forth below:

"aerosol" means a gas that contains suspended particles in solid and/or liquid form;

"clean air" means a volume of atmospheric ambient air that has been filtered to remove contaminants;

"contaminants" means particles and/or other substances that generally may not be considered to be particles (e.g., organic vapors, et cetera) but which may be suspended in air, including air in an exhale flow stream;

"exhalation valve" means a valve designed for use on a filtering face mask to open in response to pressure from exhaled air and to remain closed when a wearer inhales and between breaths;

"exhaled air" is air that is exhaled by a filtering face mask wearer;

"exhale filter element" means a porous structure through which exhaled air can pass and which is capable of removing contaminants from an exhale flow stream;

"exhale flow stream" means the stream of air that passes through an orifice of an exhalation valve;

"exterior gas space" means the ambient atmospheric air space into which exhaled gas enters after passing through the exhalation valve and significantly beyond the face mask;

"filtering face mask" means a mask that covers at least the nose and mouth of a wearer and that is capable of supplying clean air to a wearer;

"inhale filter element" means a porous structure through which inhaled air passes before being inhaled by the wearer so that contaminants and/or particles can be removed therefrom;

"interior gas space" means the space into which clean air enters before being inhaled by the wearer and into which exhaled air passes before passing through the exhalation valve's orifice;

"mask body" means a structure that can fit at least over the nose and mouth of a person and that helps define an interior gas space separated from an exterior gas space;

"particles" means any liquid and/or solid substance that is capable of being suspended in air, for example, pathogens, bacteria, viruses, mucous, saliva, blood, etc.

"porous structure" means a mixture of a volume of solid material and a volume of voids which defines a three-dimensional system of interstitial, tortuous channels through which a gas can pass.

BRIEF DESCRIPTION OF THE DRAWINGS

Referring to the drawings, where like reference characters are used to indicate corresponding structure throughout the several views.

DETAILED DESCRIPTION OF PREFERRED EMBODIMENTS

This invention has utility with many types of filtering face masks, including half masks that cover the wearer's nose and mouth; full face respirators that cover the wearer's nose, mouth, and eyes; full body suits and hoods that supply clean air to a wearer; powered and supplied air masks; self-contained breathing apparatus; and essentially any other filtering face mask that may be fitted with an exhalation valve. The invention is particularly suitable for use with filtering face masks that have a porous mask body that acts as a filter.

According to various embodiments of the present invention, the exhale filter element may be placed upstream to the exhalation valve orifice in the mask interior so that particles in aerosols are collected before passing through the exhalation valve. In another embodiment, the exhale filter element may be placed between the mask body and the opening to the exhalation valve. In yet other embodiments, the exhale filter element may be placed downstream to the exhalation valve so that air passing through the exhalation valve subsequently passes through the exhale filter element. Other embodiments include an exhale filter element covering not only the valve housing but larger portions of the mask body and even the entire exterior of the mask body to provide increased filter surface area and lower exhalation resistance or pressure drop across the exhale filter element. The invention also can include embodiments where the mask cover webs or shaping layers act as the exhale filter element or where the valve cover is the exhale filter element.

Figure 1:
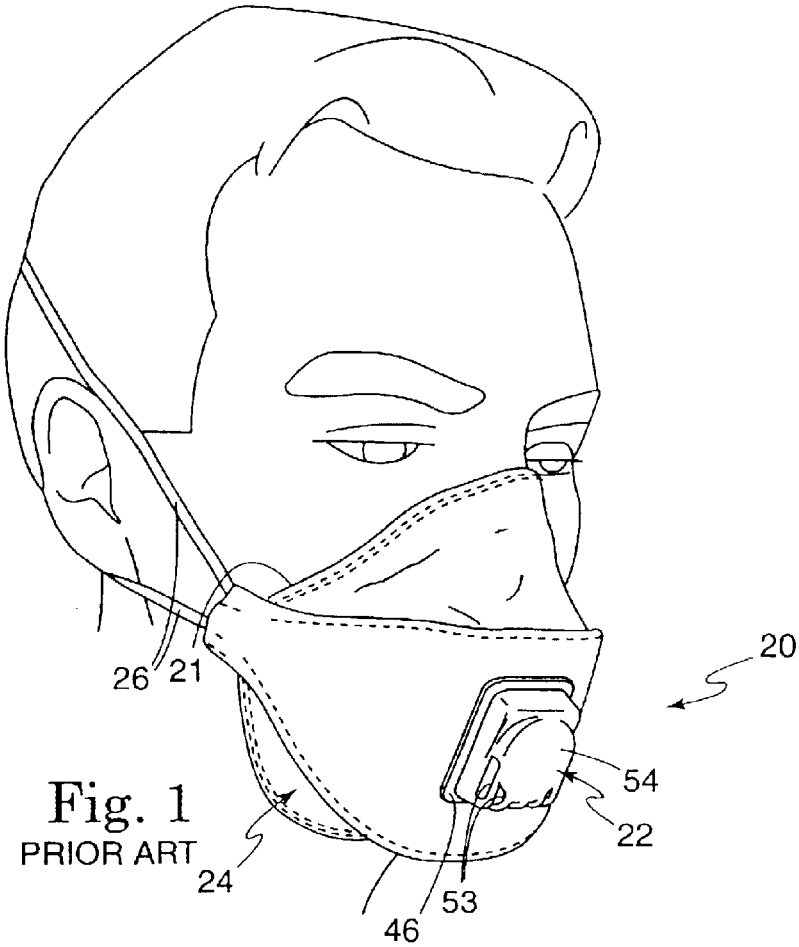
Fig. 1 PRIOR ART
FIG. 1 is a perspective view of a filtering face mask 20 that is fitted with an exhalation valve 22.

In FIG. 1, there is shown a face mask 20 that has an exhalation valve 22 disposed centrally on mask body 24. Mask body 24 is configured in a generally cup-shaped configuration when worn to fit snugly over a person's nose and mouth. The mask 20 is formed to maintain a substantially leak free contact with the wearer's face at its periphery 21. Mask body 24 is drawn tightly against a wearer's face around the mask periphery 21 by bands 26 that extend behind the wearer's head and neck when the mask is worn. The face mask 20 forms an interior gas space between the mask body 24 and the wearer's face. The interior gas space is separated from the ambient atmospheric air or exterior gas space by the mask body 24 and the exhalation valve 22. The mask body can have a conformable nose clip 25 (see FIGS. 7–9) mounted on the inside of the mask body 24 (or outside or between layers) to provide a snug fit over the nose and where the nose meets the cheek bone. A mask having the configuration shown in FIG. 1 is described in U.S. patent application Ser. No. 08/612,527 to Bostock et al., and in U.S. Design patent applications Ser. No. 29/059,264 to Henderson et al., Ser. No. 29/059,265 to Bryant et al., and Ser. No. 29/062,787 to Curran et al. Face masks of the invention may take on many other configurations, such as flat masks and cup-shaped masks shown, for example, in U.S. Pat. No. 4,807,619 to Dyrud et al. The nose clip may have the configuration described in U.S. Pat. No. 5,558,089 to Castiglione. The mask also could have a thermochromic fit indicating seal at its periphery to allow the wearer to easily ascertain if a proper fit has been established—see U.S. Pat. No. 5,617,849 to Springett et al.

The exhalation valve 22 that is provided on mask body 24 opens when a wearer exhales in response to increased pressure inside the mask and should remain closed between breaths and during an inhalation. When a wearer inhales, air is drawn through the filtering material, which can include a fibrous non-woven filtering material 27 (FIGS. 2, 4–9). Filtering materials that are commonplace on negative pressure half mask respirators like the respirator 20 shown in FIG. 1 often contain an entangled web of electrically charged melt-blown microfibers (BMF). BMF fibers typically have an average fiber diameter of about 10 micrometers ($\mu$m) or less. When randomly entangled in a web, they have sufficient integrity to be handled as a mat. Examples of fibrous materials that may be used as filters in a mask body are disclosed in U.S. Pat. No. 5,706,804 to Baumann et al., U.S. Pat. No. 4,419,993 to Peterson, U.S. Reissue Pat. No. Re 28,102 to Mayhew, U.S. Pat. Nos. 5,472,481 and 5,411,576 to Jones et al., and U.S. Pat. No. 5,908,598 to Rousseau et al. The fibrous materials may contain additives to enhance filtration performance, such as the additives described in U.S. Pat. Nos. 5,025,052 and 5,099,026 to Crater et al., and may also have low levels of extractable hydrocarbons to improve performance; see, for example, U.S. patent application Ser. No. 08/941,945 to Rousseau et al. Fibrous webs also may be fabricated to have increased oily mist resistance as shown in U.S. Pat. No. 4,874,399 to Reed et al., and in U.S. patent application Ser. Nos. 08/941,270 and 08/941,864, both to Rousseau et al. Electric charge can be imparted to nonwoven BMF fibrous webs using techniques described in, for example, U.S. Pat. No. 5,496,507 to Angadjivand et al., U.S. Pat. No. 4,215,682 to Kubik et al., and U.S. Pat. No. 4,592,815 to Nakao.

Figure 2:
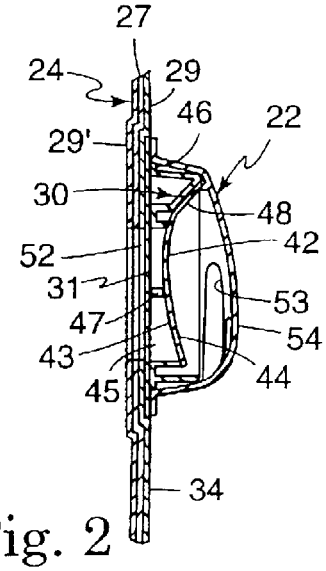
FIG. 2 is a sectional side view of an exhalation valve 22, illustrating a first embodiment of an exhale filter element 31 according to the invention.

FIG. 2 shows the exhalation valve 22 in cross-section mounted on the mask body 24. Mask body 24 acts as an inhale filter element and includes a filter layer 27, an outer cover web 29, and an inner cover web 29'. The inhale filter element is integral with the mask body 24. That is, it forms part of the mask body and is not a part that subsequently becomes attached to the body. The outer and inner cover webs 29 and 29' protect the filter layer 27 from abrasive forces and retain any fibers that may come loose from the filter layer 27. The cover webs 29, 29' may also have filtering abilities, although typically not nearly as good as the filtering layer 27. The cover webs may be made from nonwoven fibrous materials containing polyolefins and polyesters (see, e.g., U.S. Pat. Nos. 4,807,619 and 4,536,440 and U.S. patent application Ser. No. 08/881,348 filed Jun. 24, 1997). The exhalation valve 22 includes a valve seat 30 and a flexible flap 42. The flexible flap 42 rests on a seal surface 43 when the flap is closed but is lifted from that surface 43 at free end 44 and dynamically bends when a significant pressure is reached during an exhalation. The seal surface 43 of the valve generally curves in a concave cross-section when viewed from a side elevation. When the exhalation pressure ceases, the flap returns to its rest position as shown in FIG. 2.

Figure 3:
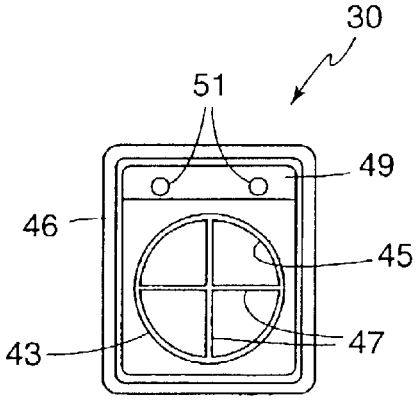
Fig. 3 PRIOR ART
FIG. 3 is a front view of a valve seat 30 that is utilized in connection with valve 22.

FIG. 3 shows the valve seat 30 from a front view. The valve seat 30 has an orifice 45 that is disposed radially inward to seal surface 43. Orifice 45 can have cross members 47 that stabilize the seal surface 43 and ultimately the valve 22 (FIG. 2). The cross members 47 also can prevent flap 42 (FIG. 2) from inverting into orifice 45 during an inhalation. The flexible flap 42 is secured at its fixed portion 48 (FIG. 2) to the valve seat 30 on flap retaining surface 49. Flap retaining surface 49, as shown, is disposed outside the region encompassed by the orifice and can have pins 51 to help mount the flap to the surface. Flexible flap 42 (FIG. 2) can be secured to surface 49 using sonic welding, an adhesive, mechanical clamping, and the like. The valve seat 30 also has a flange 46 that extends laterally from the valve seat 30 at its base to provide a surface that allows the exhalation valve 22 (FIG. 2) to be secured to mask body 24. The valve 22 shown in FIGS. 2 and 3 is more fully described in U.S. Pat. Nos. 5,509,436 and 5,325,892 to Japuntich et al. Unlike the valve described in these two patents, the valve 22 shown in FIG. 2 has an exhale filter element 31 disposed in the exhale flow stream.

The exhale filter element 31 shown in FIG. 2 is disposed between the filter material 27 in mask body 24 and the base 46 of the exhalation valve 22. The exhale filter element 31 thus is located downstream to opening 52 in mask body 24. Air that is exhaled by the wearer enters the mask's interior gas space, which in FIG. 2 would be located to the left of mask body 24. Exhaled air leaves the interior gas space by passing through an opening 52 in the mask body 24. Opening 52 is circumscribed by the valve 22 at its base 46. Before passing through the valve orifice 45, the exhaled air passes through the exhale filter element 31. The exhale filter element 31 removes contaminants that may be present in the exhale flow stream, for example, suspended particles in the wearer's exhaled aerosol. After passing through the exhale filter element 31, the exhaled air then exits the valve orifice 45 as the free end 44 of the flexible flap is lifted from the seal surface 43 in response to a force generated by the wearer's exhaled air. All exhaled air should pass through the mask body's filtering material 27 or through the exhale filter element 31. The exhaled air that passes through the mask body's filtering material 27 or the exhale filter element 32 then enters the atmosphere. Under ideal conditions, exhaled air is not allowed to enter the atmosphere unfiltered unless it inadvertently escapes from the mask at, for example, its periphery 21 (FIG. 1).

The exhaled air that leaves the interior gas space through valve orifice 45 then proceeds through ports 53 in the valve cover 54 to enter the exterior gas space. The valve cover 54 extends over the exterior of the valve seat 30 and includes the ports 53 at the sides and top of valve cover 54. A valve cover having this configuration is shown in U.S. Pat. No. Des. 347,299 to Bryant et al. Other configurations of other exhalation valves and valve covers may also be utilized (see U.S. Pat. No. Des. 347,298 to Japuntich et al. for another valve cover).

Resistance or pressure drop through the exhale filter element preferably is lower than the resistance or pressure drop through the inhale filter element of the mask body. Because exhaled air will follow the path of least resistance, it is important to use an exhale filter element that exhibits a lower pressure drop than the mask body, preferably lower than the filter media in mask body, so that a major portion of the exhaled air passes through the exhale filter media, rather than through the filter media of the mask body. To this end, the exhalation valve, including the exhale filter element, should demonstrate a pressure drop that is less than the pressure drop across the filter media of the mask body. Most or substantially all exhaled air thus will flow from the mask body interior, out through the exhalation valve, and through the exhale filter element. If airflow resistance due to the exhale filter element is too great so that air is not readily expelled from the mask interior, moisture and carbon dioxide levels within the mask can increase and may cause the wearer discomfort.

Figure 4:
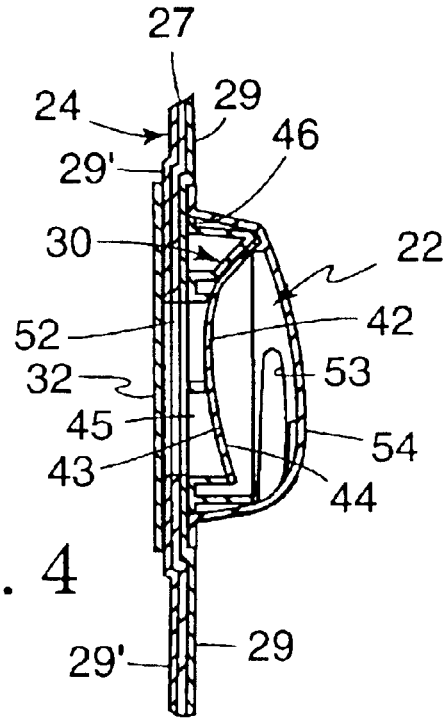
FIG. 4 is a sectional side view of an exhalation valve 22, illustrating a second embodiment of an exhale filter element 32 in accordance with the invention.

FIG. 4 shows an exhale filter element 32 disposed in another location. In this embodiment, the exhale filter element 32 is placed on the interior of the mask body 24 upstream to the opening 52 in the filter media. As in the previous embodiment, the exhaled air lifts flexible flap 42 upon exiting orifice 45 and then passes out ports 53 in valve cover 54. Exhaled air passes through exhale filter element 32 before passing through filter media opening 52 and valve orifice 45. As in other embodiments, the exhale filter element 32 may be secured to the mask in this location by, for example, mechanical fastening (e.g., snap or friction fit), ultrasonic welding, or use of an adhesive.

Figure 5:
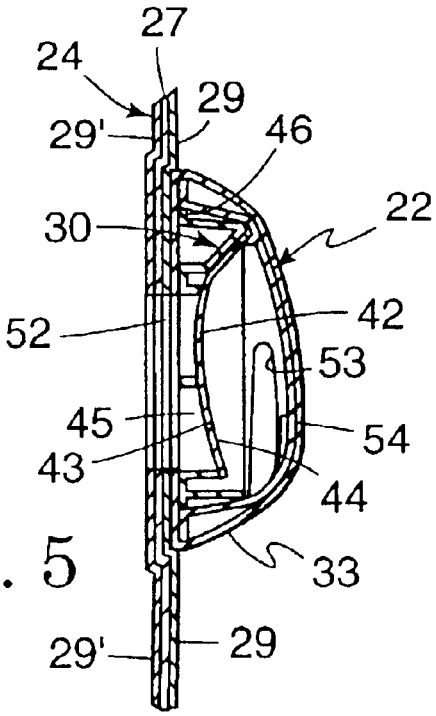
FIG. 5 is a sectional side view of an exhalation valve 22, illustrating a third embodiment of an exhale filter element 33 in accordance with the invention.

FIG. 5 shows an exhale filter element 33 that extends over and around the valve cover 54 of the exhalation valve 22. The exhale filter element 33 is preferably juxtaposed tautly against the valve cover's exterior and is held between the mask body 24 and the valve seat 30 and valve cover 54. When disposed in this location, the exhaled air passes through the exhale filter element 33 after passing through the ports 53 in the valve cover 54. Embodiments such as this one may be advantageous in that placement of exhale filter element 33 downstream to the valve orifice 45 and flap 42 allows the exhale flow stream to strike the valve flap 42 unencumbered. That is, the downstream placement of the exhale filter element may avoid a momentum decrease in the exhale flow stream which could impede valve opening performance. The downstream placement may also be advantageous in that it provides better prophylactic coverage of the valve and can collect particles that could be generated by breakage of a condensation meniscus between the valve flap 42 and the valve seat 30.

Figure 6:
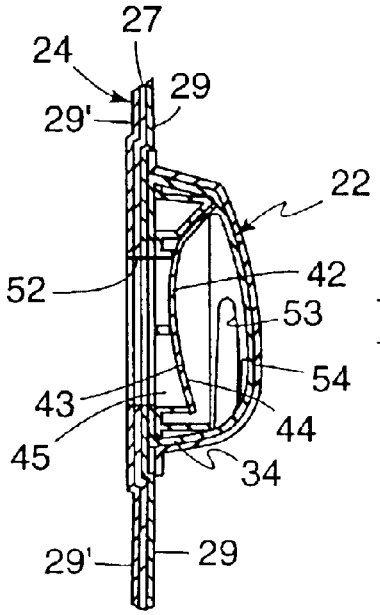
FIG. 6 is a side sectional view of an exhalation valve shown 22, illustrating a fourth embodiment of an exhale filter element 34 in accordance with the invention.

FIG. 6 shows an exhale filter element 34 that is located on the interior of the valve cover 54. The exhale filter element 34 is held between the valve seat 30 and the mask body 24 and between the valve seat 30 and the valve cover 54. Air that is exhaled thus passes through the exhale filter element 34 before passing through the ports 53 in the valve cover 54 but after passing through valve orifice 45. The downstream location of the exhale filter element 34 in this embodiment may likewise be advantageous as described above in reference to FIG. 5.

Figure 7:
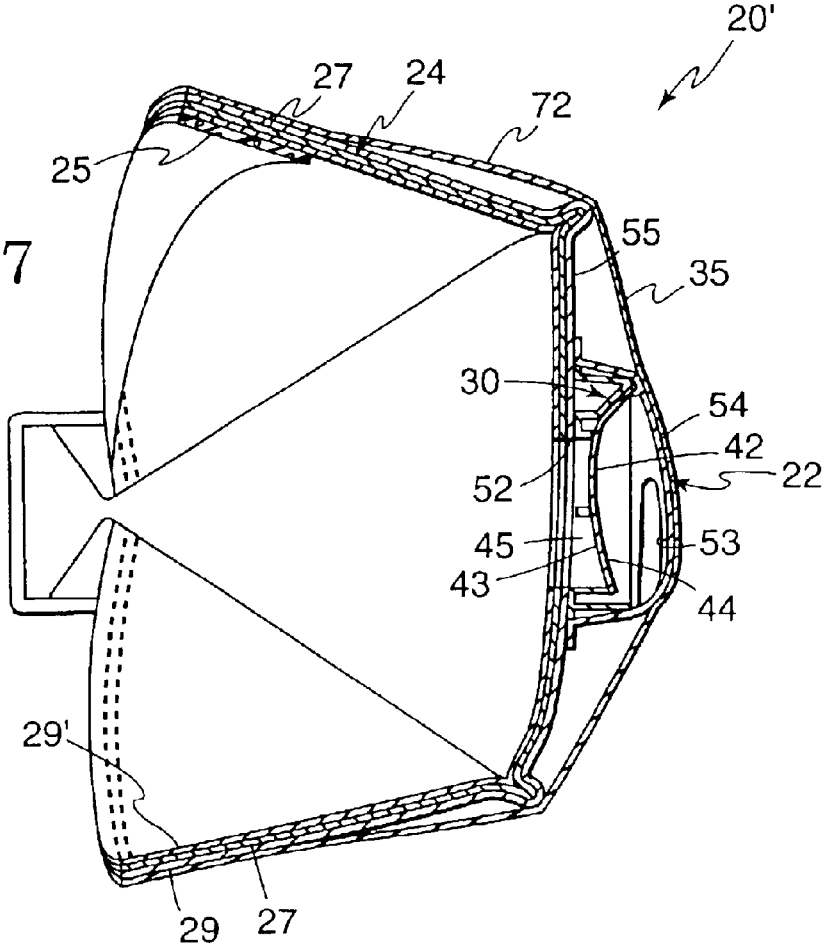
FIG. 7 is a sectional side view of a mask 20' similar to mask 20 shown in FIG. 1, illustrating a fifth embodiment of an exhale filter element 35 in accordance with the invention.

FIG. 7 also shows an exhale filter element that is located downstream to the valve flap 42. The exhale filter element 35 has an expanded surface area relative to the other embodiments. The exhale filter element 35 extends completely over the exterior of the exhalation valve 22 and the mask body 24. Because the exhale filter element 35 has a surface area that is slightly larger than the surface area of the mask body 24 (or the filter media 27 in the mask body 24), less pressure drop would be exhibited across the exhale filter element 35 than the mask body 24 (when the same filter media is used in each), and therefore exhaled air will easily pass from the interior gas space to the exterior gas space through opening 52 in mask body 24 and through the exhalation valve's orifice 45. Filter media 27 that is used in mask body 24 typically is a high performance media that exhibits very low particle penetration (see the above discussion and patents and patent applications cited above regarding BMF filter media, electret charging, and fiber additives). The particle penetration commonly is sufficient to meet NIOSH requirements set forth in 42 C.F.R. part 84. Particle penetration and pressure drop move inversely to each other (lower penetrations are, commonly accompanied by higher pressure drops). Because less pressure drop would be demonstrated by element 35 when compared to mask body 24, the embodiment shown in FIG. 7 is advantageous in that the filter media used in the exhale filter element 35 can be a high performance media like that used in the mask body.

Figure 8:
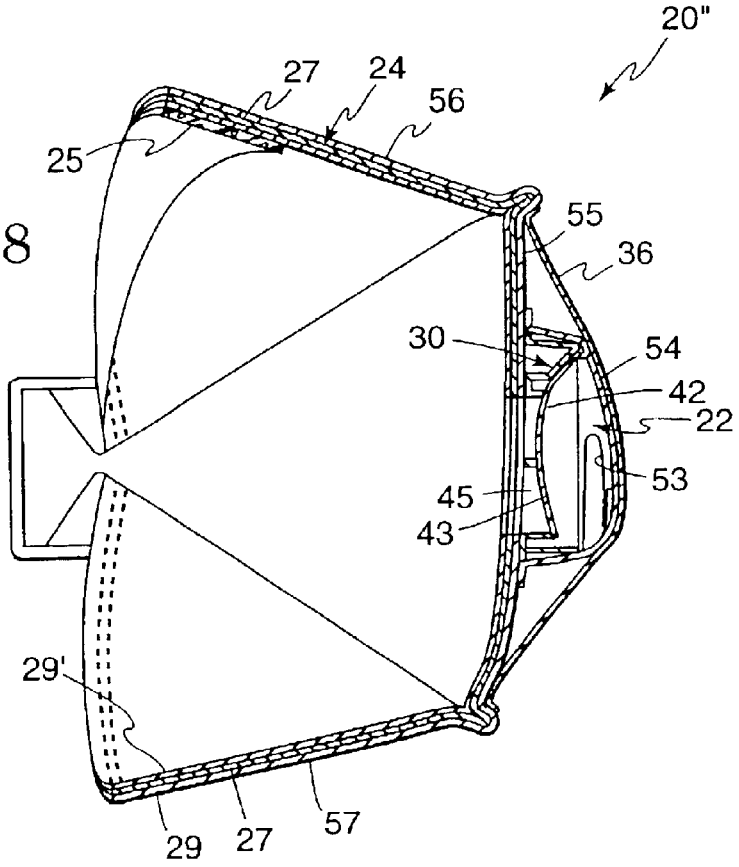
FIG. 8 is a sectional side view of a mask 20" similar to mask 20 shown in FIG. 1, illustrating a sixth embodiment of an exhale filter element 36 in accordance with the invention.

In FIG. 8 the exhale filter element 36 also is disposed downstream to the ports 53 in valve cover 54. Unlike the embodiment illustrated in FIG. 7, however, the surface area of the exhale filter element 36 is less than the surface area of the mask body 24. The exhale filter element 36 is secured to the mask body 24 where the mask body's central panel 55 meets the top panel 56 and lower panel 57. Although the exhale filter element 36 does not cover a surface area that is greater than the mask body 24, it is nonetheless an enlarged surface area when compared to other embodiments. Thus, the exhalation filter element 36 may not necessarily be able to demonstrate the penetration and pressure drop values that are exhibited by the filter media 27, but it may nonetheless be a very good performing filtration media that exhibits low particle penetration. If the inner and outer cover webs 29 and 29' add significantly to the overall pressure drop of the mask body 24, then it may be possible that the exhale filter element 36 would be able to be as good a performing filter media as the filter media 27 used in mask body 24.

Figure 9:
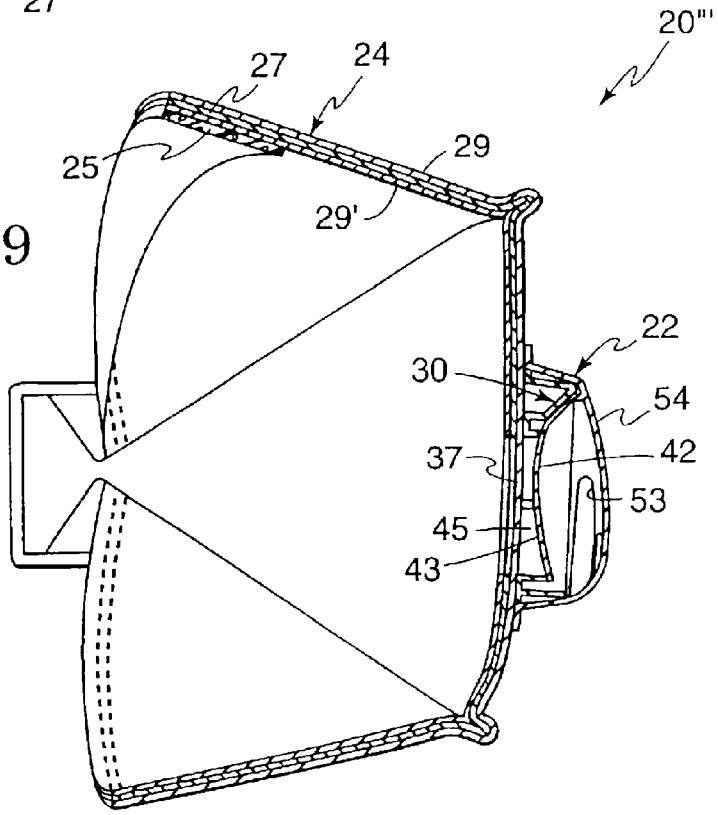
FIG. 9 is a sectional side view of a mask 20'" similar to mask 20 shown in FIG. 1, illustrating a seventh embodiment of an exhale filter element 37 in accordance with the invention.

In FIG. 9, the exhale filter element 37 is the outer cover web 29. This embodiment is advantageous in that it may be relatively easy to manufacture. The product can be made by punching a hole through the other layers 27, 29' in mask body 24, followed by applying the outer cover web 29 after the holes are punched. The embodiment may be beneficial for a continuous line manufacturing process. Alternatively, the inner cover web 29' could act as the exhale filter element, and the outer cover web 29 could have a hole disposed therein. Or both layers 29, 29' could act as an exhale filter element.

Figure 10:
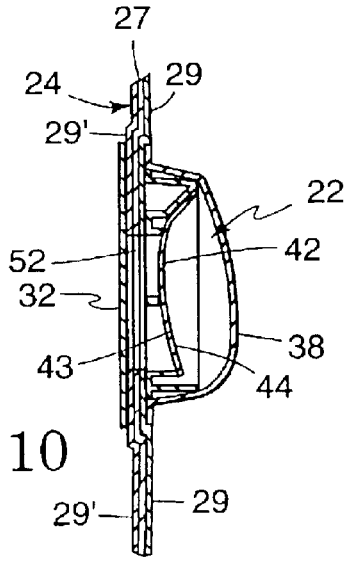
FIG. 10 is a sectional side view of an exhalation valve 22 having an exhale filter element 38 in accordance with the invention.
Figure 10A:
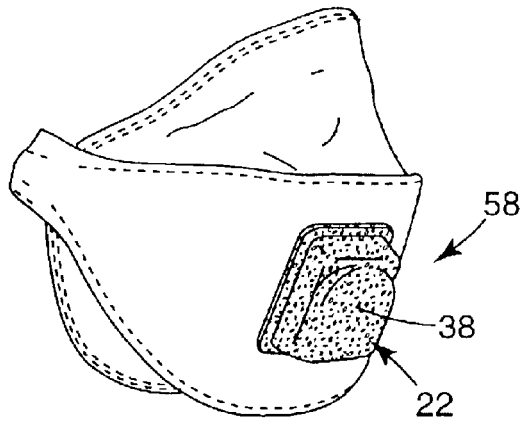
FIG. 10*a* is a perspective view of a filtering face mask 58 having an exhale filter element 38 in accordance with the invention.

In FIG. 10 and FIG. 10*a*, the filtering face mask 58 has an exhalation valve 22 having an exhale filter element shown as a filtering cover 38 constructed of a sintered plastic or other material having sufficient rigidity as well as a porous structure that provides filtering capabilities. Examples of materials that could be used to produce a sintered valve cover include, VYLON HP (1 mm grain size), VYLON HP (2 mm grain size), VYLON TT1/119, and VYLON HP (2.5 mm grain size) all made with a polypropylene base material available from Porvair Technology Ltd., Wrexham, Clwyd, Wales, United Kingdom. The sintered or porous valve covers may be made from sheets produced from the grains. The sheet material can be cut into pieces that are assembled in the form of a valve cover. Alternatively, the grains can be heated and pressed over a tool adapted to form a valve cover. The valve cover 38 does not have the ports 53 like the valve cover 50 shown in FIGS. 2, 5–9, and 11. Rather, the air that flows through the valve 24 passes through the porous structure of the filtering valve cover 38. Using this integrated configuration, an exhale filter element separate from the valve cover is not required.

Figure 11:
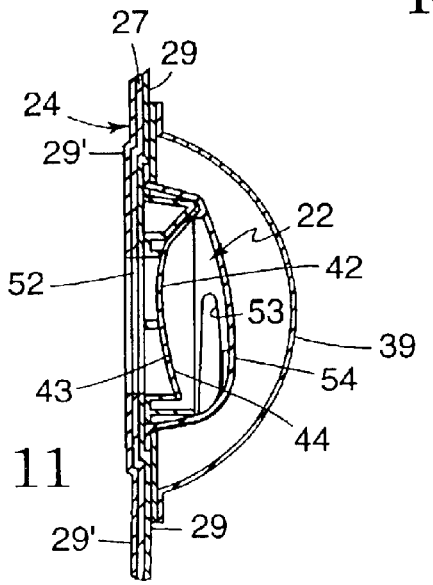
FIG. 11 is a sectional side view of an exhalation valve 22 having a detachable exhale filter element 39 in accordance with the invention.

FIG. 11 shows an exhalation valve 22 that has an exhale filter element 39 that is removable and preferably replaceable. The removable filter element 39 extends over and snaps onto the valve cover 54 using conventional or other fastening means. An impermeable layer (not shown) may be disposed between the valve cover 54 and the mask body 24 to prevent re-entry of exhaled moisture. The removable filter element 39 may be configured to snap onto and form a tight seal to the valve cover 54 or may be attached in other manners known in the art, e.g. pressure sensitive or repositionable adhesive bonding. The removable filter element 39 may possess a porous structure such as a thermally bonded nonwoven fibrous web, or it may be made of a sintered or porous material as described above. This embodiment allows the exhale filter element to be replaced before the mask has met its service life.

Figure 12:
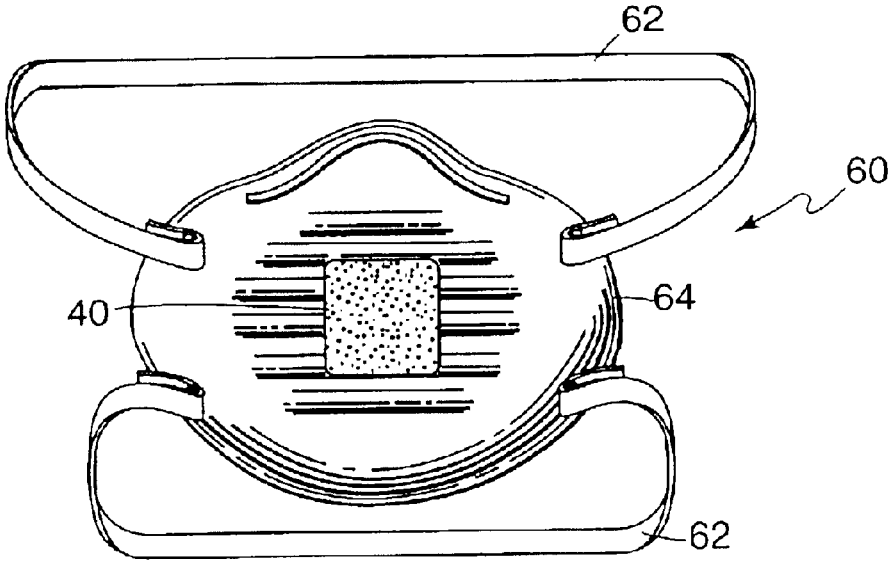
FIG. 12 is a front view of a filtering face mask 60 that has an exhale filter element 40 in accordance with the invention.

FIG. 12 illustrates a second embodiment of a cup-shaped face mask, generally designated 60. The face mask 60 includes bands 62 that are connected to a mask body 64 and that extend around the back of the wearer's head and neck for retaining the mask against the face. The mask body 64 acts as an inhale filter element and is generally made of fibrous filtering material as described above and may also include inner and/or outer cover web layers—see, for example, U.S. Pat. No. 5,307,796 to Kronzer et al., U.S. Pat. No. 4,807,619 to Dyrud, and U.S. Pat. No. 4,536,440 to Berg. Similar to the embodiment shown in FIGS. 1–7, the face mask 60 may include an exhalation valve similar to the valve in the other embodiments. An exhale filter element 40 that covers the exterior of the valve cover (not shown) may be employed to prevent contaminants from entering the exterior gas space. The exhale filter element may be attached as illustrated above in FIG. 5. The exhale filter element also may be positioned as described above in reference to the other figures. The face mask also may be configured in cup shapes other than the embodiments shown in FIG. 12 and the figures described above. The mask could, for example, have the configuration shown in U.S. Pat. No. 4,827,924 to Japuntich.

Figure 13:
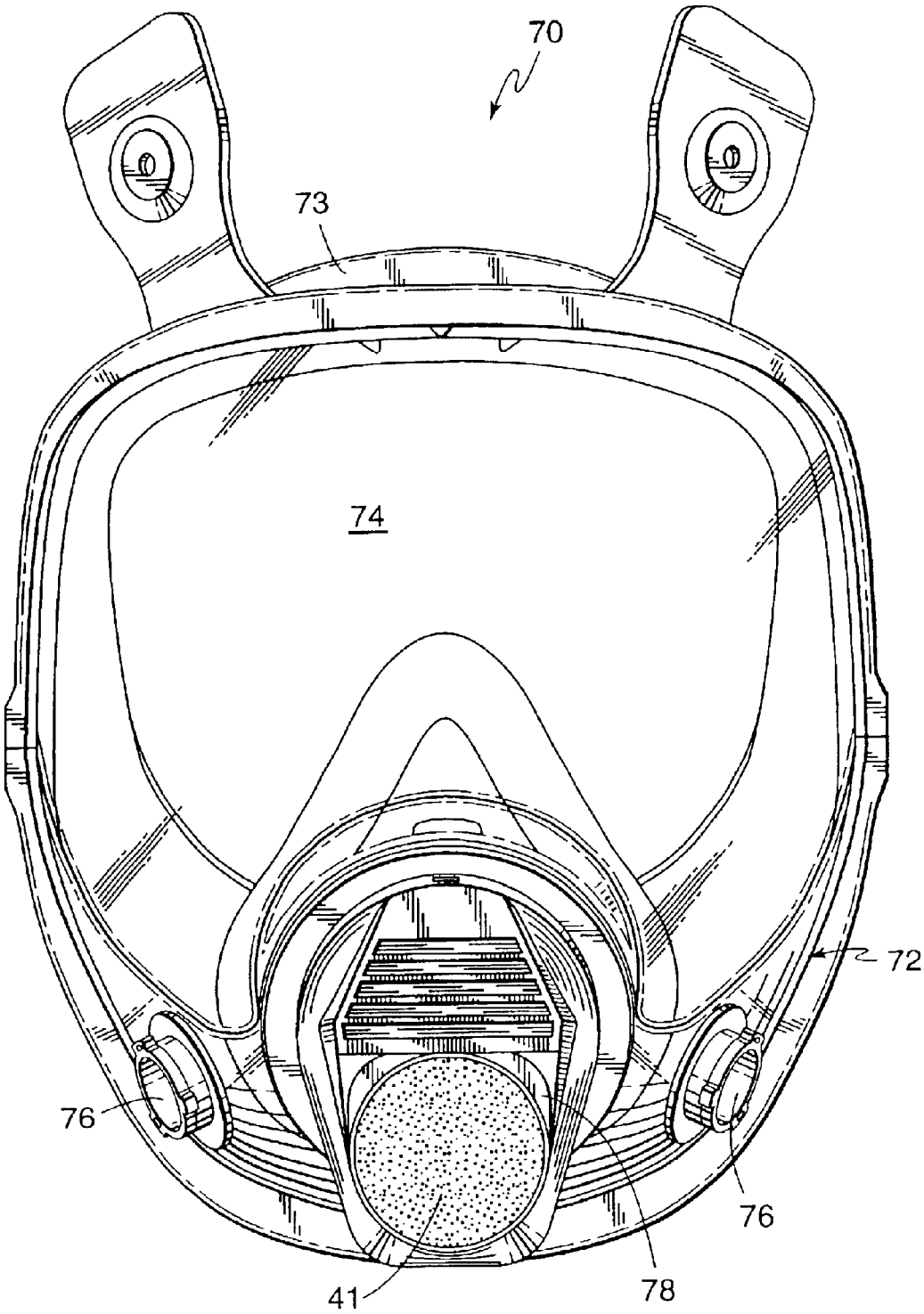
FIG. 13 is a front view of a full face filtering mask 70, illustrating an exhale filter element 41 in accordance with the invention.

FIG. 13 illustrates a full face respirator 70 that includes a mask body 72, which typically includes a non-porous plastic and/or rubber face seal 73 and a transparent shield 74. The mask body 72 is configured for covering the eyes, nose, and mouth of the wearer and forms a seal against the wearer's face. The mask body 72 includes inhalation ports 76 that are configured for receiving removable filter cartridges (not shown) such as described in Minnesota Mining and Manufacturing Company's Health and Environmental Safety brochure 70-0701-5436-7 (535)BE, dated Apr. 1, 1993. The ports 76 should include a one way inhalation valve that allows air to flow into the mask. The filter cartridges filter the air drawn into the mask before it passes through ports 76. The mask 70 includes bands or a harness (not shown) to extend over the top of the wearer's head or behind the wearer's head and neck for retaining the mask 70 against the wearer's face. A face mask of this construction is also shown and described in U.S. Pat. No. 5,924,420 to Reischel et al. and in U.S. Pat. No. Des. 388,872 to Grannis et al. and U.S. Pat. No. Des. 378,610 to Reischel et al.

The mask body 72 includes an exhalation valve 78 generally at the center lower portion of the mask 70. The exhalation valve 78 may include a circular flap-type diaphragm (not shown) retained at its center with a barb extending through an orifice in the center of the flap. Such exhalation valves are described, for example, in U.S. Pat. No. 5,062,421. The present invention also includes an exhale filter element 41 placed over the outer portion of the valve housing. The exhale filter element 41 may be placed in other positions along the exhale flow stream and proximate the exhalation valve similar to the locations shown in other figures. The exhale filter element 41 may be fashioned to be detachable and replaceable. The exhale filter element preferably is adapted such that its placement in the exhale flow stream allows the exhale filter element to reside in the path of least resistance so that the exhale filter element does not substantially discourage flow through the exhalation valve.

In all the embodiments shown, under normal circumstances substantially all exhaled air passes through either the mask body or the exhale filter element 31-41. Although the air may engage the exhale filter element at various points in the exhale flow stream, no matter where positioned the exhale filter element enables contaminants to be removed from the exhale flow stream to furnish some level of protection to other persons or things while at the same time providing improved wearer comfort and allowing the wearer to don a tightly fitting mask. The exhale filter element may not necessarily remove all contaminants from an exhale flow stream, but preferably removes at least 95 percent, and more preferably at least 97 percent, and still more preferably at least 99 percent when tested in accordance with Bacterial Filtration Efficiency Test described below.

To provide the wearer with good comfort while wearing masks of the invention, the mask preferably enables at least 50 percent of air that enters the interior gas space to pass through the exhale filter element. More preferably, at least 75 percent, and still more preferably at least 90 percent, of the exhaled air passes through the exhale filter element, as opposed to going through the filter media or possibly escaping at the mask periphery. When the valve described in U.S. Pat. Nos. 5,509,436 and 5,325,892 to Japuntich are used on the respirator, and the exhale filter element demonstrates a lower pressure drop than the mask body, more than 100 percent of the air can pass through the exhale filter element. As described in the Japuntich et al. patents, this can occur when air is passed into the filtering face mask at a velocity of at least 8 meters per second under a Percent Flow Through Valve Test (described below). Because greater than 100 percent of the exhaled air passes out through the valve, there is a net influx of air through the filter media. The air that enters the interior gas space through the filter media is less humid and cooler and therefore improves wearer comfort.

The embodiments of the exhale filter element that are filters covering larger portions of the mask body have increased surface area so that resistance through the exhale filter element is effectively decreased. Lower resistance in the exhale flow stream increases the percentage of exhaled air passing through the exhalation valve rather than through the mask body. Different materials and sizes for the mask body and the exhalation valve filter can create different flow patterns and pressure drop.

Many types of commercially available filter media, such as the melt-blown microfiber webs described above or spun-bonded nonwoven fibrous media, have been found to be acceptable filter media for exhale filter elements. A preferred exhale filter element comprises a polypropylene spunbonded web. Such a web may be obtained from Poly-Bond Inc., Waynesboro, Va., product number 87244. The exhale filter element also could be an open cell foam. Additionally, if the mask uses shaping layers to provide support for the filter media (see, e.g., U.S. Pat. No. 5,307,796 to Kronzer, U.S. Pat. No. 4,807,619 to Dyrud, and U.S. Pat. No. 4,536,440 to Berg), the shaping layers (also referred to as the molded mask shell material) could be used as an exhale filter element. Or the exhale filter element could be made from the same materials that are commonly used to form shaping layers. Such materials typically include fibers that have bonding components that allow the fibers to be bonded to one another at points of fiber intersection. Such thermally bonding fibers typically come in monofilament or bicomponent form. The nonwoven fibrous construction of the shaping layer provides it with a filtering capacity—although typically not as great as a filter layer—that permits the shaping layer to screen out larger particles such as saliva from the wearer. Because these fibrous webs are made from thermally bonding fibers, it can be possible to mold the webs into a three-dimensional configuration fashioned to fit over an exhalation valve as, for example, in the form of a valve cover. Generally, any porous structure that is capable of filtering contaminants is contemplated for use as an exhale filter element in the invention.

To lower pressure drop through the exhale filter element, it could be configured in an expanded surface area form. For example, it could be corrugated or pleated, or it could be in the form of a pancake shaped filter, which could be removably attached.

The exhale filter element preferably contains a fluorochemical additive(s) to impart better protection to the mask from splash fluids. Fluorochemical additives that may be suitable for such purposes are described in U.S. Pat. Nos. 5,025,052 and 5,099,026 to Crater et al., U.S. Pat. No. 5,706,804 to Baumann et al., and U.S. Pat. No. 6,127,485 to Klun et al. filed Jul. 28, 1997. The fluorochemical additive may be incorporated into the volume of solid material that is present in the porous structure of the exhale filter element, and/or it may be applied to the surface of the porous structure. When the porous structure is fibrous, the fluorochemical additive preferably is incorporated at least into some or all of the fibers in the exhale filter element.

The fluorochemical additive(s) that may be used in connection with the exhale filter element to inhibit liquid passage through the element may include, for example, fluorochemical oxazolidinones, fluorochemical piperazines, fluoroaliphatic radical-containing compounds, fluorochemical esters, and combinations thereof. Preferred fluorochemical additives include the fluorochemical oxazolidinones such as $C_8F_{17}SO_2N(CH_3)CH_2CH(CH_2Cl)OH$ (see example 1 of the Crater et al. patents) and fluorochemical dimer acid esters (see example 1 of the Klun et al. patent). A preferred commercially available fluorochemical additive is FX-1801 Scotchban™ brand protector from 3M Company, Saint Paul, Minn.

In addition to or in lieu of the noted fluorochemical additives, other materials may be employed to inhibit liquid penetration such as waxes or silicones. Essentially any product that may inhibit liquid penetration but not at the expense of significantly increasing pressure drop through the exhale filter element is contemplated for use in this invention. Preferably, the additive would be melt processable so that it can be incorporated directly into the porous structure of the exhale filter element. The additives desirably impart repellency to aqueous fluids and thus increase oleophobicity and hydrophobicity or are surface energy reducing agents.

The exhale filter element is not only useful for removing contaminants and inhibiting liquid penetration, but it may also be useful for removing unwanted vapors. Thus, the exhale filter element may have sorptive qualities for removing such contaminants. The exhale filter element may be made from active particulate such as activated carbon bonded together by polymeric particulate to form a filter element that may also include a nonwoven particulate filter as described above to provide vapor removal characteristics as well as satisfactory particulate filtering capability. An example of a bonded particulate filter is disclosed in U.S. Pat. Nos. 5,656,368, 5,078,132, and 5,033,465 to Braun et al. and U.S. Pat. No. 5,696,199 to Senkus et al. An example of a filter element that has combined gaseous and particulate filtering abilities is disclosed in U.S. Pat. No. 5,763,078 to Braun and Steffen. The exhale filter element could also be configured as a nonwoven web of, for example, melt-blown microfibers which carries active particulate such as described in U.S. Pat. No. 3,971,373 to Braun. The active particulate also can be treated with topical treatments to provide vapor removal; see, e.g., U.S. Pat. Nos. 5,496,785 and 5,344,626 both to Abler.

Face masks that have an exhale filter element according to the invention have been found to meet or exceed industry standards for characteristics such as fluid resistance, filter efficiency, and wearer comfort. In the medical field, the bacterial filter efficiency (BFE), which is the ability of a mask to remove particles, usually bacteria expelled by the wearer, is typically evaluated for face masks. BFE tests are designed to evaluate the percentage of particles that escape from the mask interior. There are three tests specified by the Department of Defense and published under MIL-M-36954C, Military Specification: Mask, Surgical, Disposable (Jun. 12, 1975) which evaluate BFE. As a minimum industry standard, a surgical product should have an efficiency of at least 95% when evaluated under these tests.

BFE is calculated by subtracting the percent penetration from 100%. The percent penetration is the ratio of the number of particles downstream to the mask to the number of particles upstream to the mask. Filtering face masks that use a polypropylene BMF electrically-charged web and have an exhale filter element according to the present invention are able to exceed the minimum industry standard and may even have an efficiency greater than 97%.

Face masks also should meet a fluid resistance test where five challenges of synthetic blood are forced against the mask under a pressure of 5 pounds per square inch (psi). If no synthetic blood passes through the mask, it passes the test, and if any synthetic blood is detected, it fails. Masks that have an exhalation valve and exhale filter element according to the present invention have been able to pass this test when the exhale filter element is placed on the exterior or ambient air side of the valve as well as on the interior or face side of the exhalation valve. Thus, the filtering face masks of the present invention can provide good protection against splash fluids when in use.

Wearer comfort improves when a large percentage of exhaled air freely passes out through the exhalation valve as opposed to the mask body or its periphery. Tests have been conducted where a compressed air stream is directed into the interior gas space of a face mask while measuring pressure drop across the mask body. Although results vary depending on the filter material used for the inhale filter element and also on the location and type of the exhale filter element in the present invention, it was found that at a flow rate of approximately seventy-nine liters per minute over 95% of the air can leave the interior gas space through the valve and less than 5% through the filtering material in the mask body when using a commercially available polypropylene spun bonded web material (87244 available from PolyBond of Waynesboro, Va.) as the exhale filter element.

EXAMPLES

Face masks that have an exhale filter element were prepared as follows. The exhalation valves that were used are described in U.S. Pat. No. 5,325,892 to Japuntich et al. and are available on face masks from 3M Company as 3M Cool Flow™ Exhalation Valves. A hole two centimeters (cm) in diameter was cut in the center of 3M brand 1860™ respirator to accommodate the valve. The valve was attached to the respirator using a sonic welder available from Branson (Danbury, Conn.). 3M brand 8511™ face mask respirators that already possessed a valve were also used. The filter element was attached to the valve in several ways. In one embodiment, the filter element was welded in place between the valve seat and the mask body as shown in FIG. 2. In another construction, the exhale filter element was placed over the valve cover and cut to extend about one-half inch beyond the valve on all sides. The exhale filter element was then ultrasonically welded to the outer lip of the valve cover as shown in FIG. 5 using a sonic welder available from Branson (Danbury, Conn.). The exhale filter element can also be attached in this manner using an adhesive. In another construction, the exhale filter element was placed over the valve seat and beneath the valve cover as shown in FIG. 6. The web material extending beyond the valve seat was then tucked under the seat, and the wrapped valve was placed on the mask body over the opening. The assembly of the respirator, filter web, and valve was then ultrasonically welded together. From inside the mask the excess filter web was cut away, leaving the valve orifice unobstructed and the filter web covering the valve and being sealed around the valve periphery. In another construction, the exhale filter element was attached to the outer edge of a filtering face piece using sonic welding or an adhesive to enable the filter element to cover essentially the entire mask exterior, including the exhalation valve as shown in FIG. 7.

Bacterial Filtration Efficiency Test

The face masks as described above were tested for bacterial filtration efficiency (BFE) in a test modified from, yet based on, the Department of Defense standard MIL-M-36954C, Military Specifications: Mask, Surgical, Disposable (Jun. 12, 1975) 4.4.1.1.2 Method II as described by William H. Friedrichs, Jr. in "*The Journal of Environmental Sciences*", p 33–40 (November/December 1989).

The face masks outlined in Table 1 below were sealed in an airtight chamber. Air was pulled by vacuum into the chamber through a high efficiency particulate air (HEPA) filter and then passed through the respirator, from the interior gas space to the exterior gas space, at a constant flow of 28.3 liters per minute to simulate a constant state of exhalation. This caused the valve to remain open. A nebulizer (part number FT-13, 3M Company, Occupational Health and Environmental Safety Division, St. Paul, Minn.) was used to generate a challenge aerosol of polystyrene latex (PSL) spheres (available from Duke Scientific Corp., Palo Alto, Calif.) having a size similar to that of aerosols created by nebulizing *Staphylococcus aureus*, 2.92 $\mu$m in aerodynamic diameter, on the inside or face side of the respirator. The challenge aerosol was not charge neutralized. The challenge was generated by squeezing the nebulizer at a rate of one squeeze per second and was sampled upstream in the interior gas space and then downstream in the exterior gas space using an Aerodynamic Particle Sizer (APS 3310 from TSI Company, St. Paul, Minn.). The percent penetration was determined by dividing the concentration of particles downstream to the valve by the concentration of particles upstream to the valve and multiplying by 100. Only concentrations of particles in the size range of 2.74–3.16 $\mu$m were used to calculate penetration. BFE was calculated as 100 minus penetration. In vitro methods, such as this, have been found to be more stringent than in vivo methods, such as a modified Greene and Vesley test, described by Donald Vesley, Ann C. Langholtz, and James L. Lauer in "*Infection in Surgery*", pp 531–536 (July 1983). Therefore, it is expected that achieving 95% BFE using the method described above would be equivalent to or greater than achieving 95% BFE using the modified Greene and Vesley test. Results of evaluation using the test method described above are shown in Table 1.

TABLE 1

Results of BFE Testing of 3M ™ Cool Flow ™ Exhalation Valves Having Exhale Filter Elements Mounted on 3M 1860 ™ Respirators

| Example | Exhale Filter Element Material and Construction | BFE |
|---|---|---|
| 1 | Molded Shell Material adhesively attached to valve cover as shown in FIG. 5 | >98% |
| 2 | 2 layers of 1.25 oz/yd$^2$ turquoise-colored polypropylene 87244 spunbonded web* welded to valve cover as shown in FIG. 5 | >97.5 |
| 3 | 1 layer 50.1 g/m$^2$ polypropylene spunbonded web containing 1.14%** fluorochemical dimer acid ester additive*** and being welded to valve cover as shown in FIG. 5 | >98% |
| 4 | 1 layer of 40 g/m$^2$ polypropylene spunbonded web welded to valve cover as shown in FIG. 5 | >97% |

*All 1.25 oz. polypropylene 87244 spunbonded webs were obtained from Poly Bond, Inc., Waynesboro, Virginia.
**Percentages are expressed in these examples as weight percentages unless noted otherwise.
***See Example 1 of U.S. Pat. No. 6,127,485 to Klun et al. for description of this additive. Continued reference to this fluorochemical dimer acid ester in these Examples refers to the compound mentioned in Example 1 of the Klun et al. application. All additives in the Examples were melt processed into the fibers.

The data in Table 1 show that exhalation valves that possess exhale filter elements can achieve greater than 95% efficiency in a simulated bacterial filtration efficiency test.

Fluid Resistance Test

In order to simulate blood splatter from a patient's burst artery, a known volume of blood can be impacted on the valve at a known velocity in accordance with Australian Standard AS 4381-1996 (Appendix D) for Surgical Face Masks, published by Standards Australia (Standards Association of Australia), 1 The Crescent, Homebush, NSW 2140, Australia.

Testing performed was similar to the Australian method with a few changes described below. A solution of synthetic blood was prepared by mixing 1000 milliliters (ml) deionized water, 25.0 g Acrysol G110 (available from Rohm and Haas, Philadelphia, Pa.), and 10.0 gm. Red 081 dye (available from Aldrich Chemical Co., Milwaukee, Wis.). The surface tension was measured and adjusted so that it ranged between 40 and 44 dynes/cm by adding Brij 30™, a nonionic surfactant available from ICI Surfactants, Wilmington, Del. as needed.

The valve with the valve diaphragm propped open was placed 18 inches (46 cm.) from a 0.033 inch (0.084 cm.) orifice (18 gauge valve). Synthetic blood was squirted from the orifice and aimed directly at the opening between the valve seat and the open valve diaphragm. The timing was set so that a 2 ml volume of synthetic blood was released from the orifice at a reservoir pressure of 5 PSI (34,000 Newtons per square meter). A piece of blotter paper was placed on the inside of the valve directly below the valve seat to detect any synthetic blood penetrating to the face side of the respirator body through the valve. The valve was challenged with synthetic blood five times. Any detection of synthetic blood on the blotter paper, or anywhere within the face side of the respirator, after five challenges is considered failure; no detection of blood within the face side of the respirator after five challenges is considered passing. The respirator body was not evaluated.

Results of fluid resistance testing according to the method described above on constructions with exhale filter elements of differing materials and mounted in differing positions are shown in Table 2.

TABLE 2

Fluid Resistance of 3M ™ Cool Flow ™ Exhalation Valves Having An Exhale Filter Element Mounted on 3M 8511 ™ Respirator

| Example | Exhale Filter Element Position | Exhale Filter Element Material | Fluid Resistance Test Results |
|---|---|---|---|
| 5 | None | None | Fail |
| 6a | Element mounted between valve seat and mask body as in FIG. 2 | 1 layer of 1.25 oz/yd$^2$ polypropylene 87244 spunbonded web | Fail |
| 6b | | 2 layers of 1.25 oz/yd$^2$ polypropylene 87244 spunbonded web | Fail |
| 7 | | 110.6 g/m$^2$ polypropylene spunbonded web containing 0.65% FX-1801 Scotchban ™ brand protector | Pass |
| 8 | Element mounted over valve cover as in FIG. 5 | 50.6 g/m$^2$ polypropylene spunbonded web containing 0.66% FX-1801 ™ | Pass |
| 9 | | 50 g/m$^2$ polypropylene spunbonded web | Pass |
| 10 | | 1 layer of 1.25 oz/yd$^2$ turquoise-colored polypropylene 87244 spunbonded web and 1 layer meltblown, 75–85 g/m$^2$ 85% polypropylene, 15% polyethylene web | Pass |
| 11a | | 2 layers of 1.25 oz/yd$^2$ turquoise-colored polypropylene 87244 spunbonded web | Pass |
| 11b | | 1 layer of 1.25 oz/yd$^2$ turquoise-colored polypropylene 87244 spunbonded web | Fail |
| 12 | | 2 layers 20.7 g/m$^2$ polypropylene spunbonded web containing 0.62% FX-1801 ™ | Pass |
| 13 | | 1 layer of 1.25 oz/yd$^2$ turquoise-colored polypropylene 87244 spunbonded web and 1 layer meltblown 0.53 oz polypropylene web having an approximate fiber diameter of 7 $\mu$m | Pass |
| 14 | | 1 layer 40 g/m$^2$ polypropylene spunbonded web | Pass |
| 15 | | molded shell material**** | Pass |
| 16 | | 1 layer 50.1 g/m$^2$ polypropylene spunbonded web containing 1.14% fluorochemical dimer acid ester | Pass |
| 17 | | 1 layer 110.6 g/m$^2$ polypropylene spunbonded web containing 0.65% FX-1801 ™ | Pass |
| 18 | | 1 layer 1.5 oz/yd$^2$ polypropylene spunbonded web | Pass |

****The molded shell material used in these Examples weighed approximately 4 to 6.5 grams per square foot and had the following composition:
70% Type 254, 65/35 core/sheath Cellbond ™ white polyester staple fiber 4 denier × 2 inch from Hoechst-Celanese Corp. (Salisbury, North Carolina)
30% Type 259, Trevira ™ with 70107 finish white polyester staple fiber 3.0 denier × 1 inch from Hoechst-Celanese Corp. (Salisbury, North Carolina)

The data in Table 2 show that exhalation valves of the invention were able to provide good resistance to splash fluids.

Percent Flow Through Valve Test

Exhalation valves possessing exhale filter elements were tested to evaluate the percent of exhaled air flow that exits the respirator through the exhalation valve as opposed to exiting through the filter portion of the respirator. This parameter was evaluated using the test described in Examples 8–13 of U.S. Pat. No. 5,325,892 and described here again in brief for ease of reference.

The efficiency of the exhalation valve to purge breath is a major factor affecting wearer comfort.

The filtering face mask respirators were mounted on a metal plate such that the exhalation valve was placed directly over a 0.96 square centimeter ($cm^2$) orifice through which compressed air was directed, with the flow directed toward the inside of the mask like exhaled air. The pressure drop across the mask filter media can be determined by placing a probe of a manometer within the interior of the filter face mask.

Figure 14:
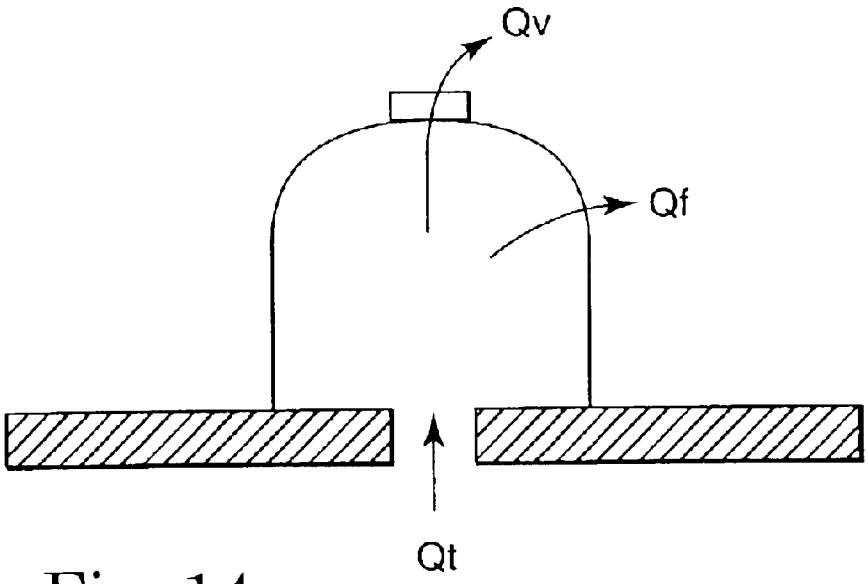
FIG. 14 is a schematic view illustrating airflows when performing a Percent Flow Through Valve Test.

The percent total flow was determined by the following method referring to FIG. 14 for better understanding. First, the linear equation describing the mask filter media volume flow ($Q_f$) relationship to the pressure drop ($\Delta P$) across the face mask was determined while having the valve held closed. The pressure drop across the face mask with the valve allowed to open was then measured at a specified exhalation volume flow ($Q_T$). The flow through the face mask filter media $Q_f$ was determined at the measured pressure drop from the linear equation. The flow through the valve alone ($Q_v$) is calculated as $Q_v=Q_T-Q_f$. The percent of the total exhalation flow through the valve is calculated by $100(Q_T-Q_f)/Q_T$.

If the pressure drop across the face mask is negative at a given $Q_T$, the flow of air through the face mask filter media into the mask interior will also be negative, giving the condition that the flow out through the valve orifice $Q_v$ is greater than the exhalation flow $Q_T$. Thus, when $Q_f$ is negative, air is actually drawn inwards through the filter during exhalation and sent through the valve, resulting in a percent total exhalation flow greater than 100%. This is called aspiration and provides cooling to the wearer. Results of testing on constructions having an exhale filter element of differing materials and mounted in differing positions are shown below in Table 3.

TABLE 3

Percent Flow Through the Valve at 42 and 79 liters/minute (LPM) of 3M ™ Cool Flow ™ Exhalation Valves Having Exhale Filter Elements Mounted on 3M 1860 ™ Respirators

| Example | Position of Exhale Filter Element | Exhale Filter Element Material | Exhale Air Flow Through Valve (%) @ 42 LPM | Exhale Air Flow Through Valve (%) @ 79 LPM |
|---|---|---|---|---|
| 19 | None | None | 76% | 104% |
| 20 | Mounted between valve seat and respirator body as shown in FIG. 2 | 2 layers of 1.25 oz/yd$^2$ turquoise-colored polypropylene 87244 spunbonded web | 31% | 41% |
| 21 | | 1 layer 50.1 g/m$^2$ polypropylene spunbonded web containing 1.14% fluorochemical dimer acid ester | 19% | 24% |

TABLE 3-continued

Percent Flow Through the Valve at 42 and 79 liters/minute (LPM) of 3M ™ Cool Flow ™ Exhalation Valves Having Exhale Filter Elements Mounted on 3M 1860 ™ Respirators

| Example | Position of Exhale Filter Element | Exhale Filter Element Material | Exhale Air Flow Through Valve (%) @ 42 LPM | Exhale Air Flow Through Valve (%) @ 79 LPM |
|---|---|---|---|---|
| 22 | Underneath valve housing but over valve diaphragm as shown in FIG. 6 | 50.6 g/m$^2$ polypropylene spunbonded web containing 0.66% FX-1801 ™ | 41% | 50% |
| 23 | | 50 g/m$^2$ polypropylene spunbonded web | 58% | 70% |
| 24 | | 1 layer of 1.25 oz/yd$^2$ turquoise-colored polypropylene 87244 spunbonded web and 1 layer melt-blown, 75–85 g/m$^2$, 85% polypropylene, 15% polyethylene web | 53% | 61% |
| 25 | Over valve housing as shown in FIG. 5 | 2 layers of 1.25 oz/yd$^2$ turquoise-colored polypropylene 87244 spunbonded web | 65% | 96% |
| 26 | Over entire respirator and valve as shown in FIG. 7 | 2 layers of 1.25 oz/yd$^2$ turquoise-colored polypropylene 87244 spunbonded web | 88% | 112% |
| 27 | Over valve housing as shown in FIG. 5 | 1 layer 1.5 oz/yd$^2$ white polypropylene spunbonded web | 47% | 71% |
| 28 | Over entire respirator and valve as shown in FIG. 7 | 1 layer 50.1 g/m$^2$ polypropylene spunbonded web containing 1.14% fluorochemical dimer acid ester | 78% | 97% |
| 29 | Over entire respirator and valve as shown in FIG. 7 | 1 layer 97.4 g/m$^2$ polypropylene spunbonded web containing 1.16% fluorochemical dimer acid ester | 48% | 73% |
| 30 | Over valve housing as shown in FIG. 5 | molded shell material | 57% | 93% |
| 31 | Over entire respirator and valve as shown in FIG.7 | 2 layers 20.7 g/m$^2$ polypropylene spunbonded web containing 0.62% FX-1801 ™ | 66% | 96% |
| 32 | Over entire respirator and valve as shown in FIG. 7 | 1 layer of 1.25 oz/yd$^2$ turquoise-colored polypropylene 87244 spunbonded web and 1 layer melt-blown 0.53 oz/yd$^2$ polypropylene web having an approximate fiber diameter of 7 $\mu$m | 66% | 99% |

The data in Table 3 demonstrate that good flow percentages through the exhalation valve can valve can be achieved by face masks of the invention.

All of the patents and patent applications cited above are incorporated by reference into this document in total.

What is claimed is:

1. A filtering face mask that comprises:

(a) a mask body;

(b) an exhalation valve that is disposed on the mask body and that has at least one orifice that allows exhaled air to pass from an interior gas space to an exterior gas space during an exhalation; and (c) an exhale filter element that does not also serve as an inhale filter element, that comprises a fibrous filter, and that is disposed in the face mask's exhale flow stream to prevent contaminants from passing from the interior gas space to the exterior gas space with the exhaled air.

2. The filtering face mask of claim 1, wherein the filtering face mask has a cup-shaped mask body that includes a filter layer.

3. The filtering face mask of claim 2, wherein the mask body includes at least one cover web in juxtaposed relation to the filter layer.

4. The filtering face mask of claim 1, wherein the mask body has an opening disposed therein where the exhalation valve is located thereon.

5. The filtering face mask of claim 4, wherein the exhale filter element is disposed upstream to the opening in the mask body.

6. The filtering face mask of claim 4, wherein the exhale filter element is disposed between the mask body and a base of the exhalation valve.

7. The filtering face mask of claim 1, wherein the exhalation valve includes a valve cover, and wherein the exhale filter element extends over and around an exterior of the valve cover.

8. The filtering face mask of claim 1, wherein the exhalation valve includes a valve cover, and wherein the exhale filter element is located on an interior of the valve cover.

9. The filtering face mask of claim 1, wherein the exhalation valve includes a valve cover and wherein the exhale filter element extends over an exterior of the valve cover and the mask body, and wherein the exhale filter element has a total surface area that is greater than a total surface area of the mask body.

10. The filtering face mask of claim 1, wherein the exhale filter element is disposed downstream to the exhalation valve and is attached to the mask body and has a total surface area that is less than a total surface area of the mask body.

11. The filtering face mask of claim 1, wherein the exhalation valve has a valve cover disposed thereon that is a porous structure, the porous structure enabling the valve cover to also act as the exhale filter element.

12. The filtering face mask of claim 11, wherein the valve cover is made of a sintered plastic.

13. The filtering face mask of claim 1, wherein the exhale filter element is removable.

14. The filtering face mask of claim 1, wherein the exhale filter element is replaceable.

15. The filtering face mask of claim 1, wherein the exhale filter element is adapted such that the placement in the exhale flow stream puts the exhale filter element in a path of least resistance when a person exhales.

16. The filtering face mask of claim 1, wherein substantially all exhaled air passes through either the mask body or the exhale filter element.

17. The filtering face mask of claim 1, wherein the exhale filter element removes at least 95% of the challenge when tested in accordance with a Bacterial Filtration Efficiency Test.

18. The filtering face mask of claim 1, wherein the exhale filter element removes at least 97% of the challenge when tested in accordance with a Bacterial Filtration Efficiency Test.

19. The filtering face mask of claim 1, wherein the mask enables at least 50% of air that enters the interior gas space to pass through the exhale filter element when tested in accordance with a Percent Flow Through Valve Test at a flow rate of 42 liters per minute.

20. The filtering face mask of claim 1, wherein the mask enables at least 75% of air that enters the interior gas space to pass through the exhale filter element when tested in accordance with a Percent Flow Through Valve Test at a flow rate of 42 liters per minute.

21. The filtering face mask of claim 1, wherein the mask enables at least 90% of air that enters the interior gas space to pass through the exhale filter element when tested in accordance with a Percent Flow Through valve Test at a flow rate of 79 liters per minute.

22. The filtering face mask of claim 1, wherein the mask is able to pass a Fluid Resistance Test.

23. The filtering face mask of claim 1, wherein the exhale filter element includes an additive that assists in inhibiting liquid penetration through the exhale filter element.

24. The filtering face mask of claim 23, wherein the exhale filter element includes a nonwoven fibrous web that contains a fluorochemical additive.

25. The filtering face mask of claim 1, wherein the exhale filter element includes fibers that have a surface and that have fluorine atoms located at the surface thereof.

26. The filtering face mask of claim 1, wherein the exhale filter element is located downstream to the valve orifice.

27. The filtering face mask of claim 1, wherein the exhalation valve includes a flexible flap that lifts from a seal surface to place the valve in an open position in response to a force from an exhalation by the wearer, the exhale filter element being located downstream to the flexible flap.

28. The filtering face mask of claim 1, wherein the exhale filter element includes a nonwoven web that contains melt-blown microfibers.

29. The filtering face mask of claim 1, wherein the exhale filter element includes a nonwoven web that contains spun-bonded polypropylene.

30. The filtering face mask of claim 1, wherein the exhale filter element includes an open-cell foam.

31. The filtering face mask of claim 1, wherein the exhale filter element includes a nonwoven web that contains thermally bonded fibers.

32. The filtering face mask of claim 1, wherein the exhale filter element is associated with a shaping layer in the mask body.

33. The filtering face mask of claim 1, wherein the exhale filter element is molded into a three-dimensional structure.

34. The filtering face mask of claim 1, wherein the exhale filter element is molded into a structure that is configured to extend over an exhalation valve flap.

35. A method of removing contaminants from an exhale flow stream, which method comprises placing the filtering face mask of claim 1 over at least a wearer's nose and mouth and then exhaling air such that a substantial portion of the exhaled air passes through the exhale filter element.

36. A method of removing contaminants from an exhale flow stream, which comprises placing the filtering face mask of claim 1 over at least a wearer's nose and mouth and then exhaling air much that a substantial portion of the exhaled air passes through the exhale filter element.

37. The filtering face mask of claim 1, wherein the mask body defines a half-mask, and wherein the inhale filter element is integral with the half-mask body.

38. The filtering face mask of claim 37, wherein the half-mask body includes at least one cover web in juxtaposed relation to the filter layer.

39. The filtering face mask of claim 37, wherein the half-mask body has an opening disposed therein where the exhalation valve is located thereon.

40. The filtering face mask of claim 37, wherein the exhale filter element comprises a fibrous filter, a sintered plastic, or an open-cell foam.

41. The filtering face mask or claim 40, wherein the pressure drop across the exhale filter element defines a path of least resistance for exhaled air.

42. A filtering face mask that comprises:

(a) a mask body;

(b) an exhalation valve that is disposed on the mask body and that has at least one orifice that allows exhaled air to pass from an interior gas space to an exterior gas space during an exhalation; and (c) an exhale filter element that does not also serve as an inhale filter element and that is disposed in the face mask's exhale flow stream downstream to the exhalation valve orifice to prevent contaminants from passing from the interior gas space to the exterior gas space with the exhaled air.

43. The filtering face mask of claim 42, wherein the exhale filter element is adapted such that the disposition in the exhale flow stream puts the exhale filter element in a path of least resistance when a wearer of the mask exhales.

44. The filtering face mask of claim 42, wherein the mask body includes at least one cover web in juxtaposed relation to a filter layer.

45. The filtering face mask of claim 42, wherein the exhalation valve includes a valve cover, and wherein the exhale filter element extends over and around the valve cover's exterior.

46. The filtering face mask of claim 42, wherein the exhalation valve includes a valve cover, and wherein the exhale filter element is located on the valve cover's interior.

47. The filtering face mask of claim 42, wherein the exhale filter element extends over an exterior of the exhalation valve and the mask body, and wherein a total surface area of the exhale filter element is greater than a total surface area of the mask body.

48. The filtering face mask of claim 42, wherein the exhale filter element is attached to the mask body and has a total surface area that is less than a total surface area of the mask body.

49. The filtering face mask of claim 42, wherein the exhalation valve has a valve cover disposed thereon that is a porous structure, the porous structure enabling the valve cover to also act as an exhale filter element.

50. The filtering face mask of claim 49, wherein the valve cover is made of a sintered plastic.

51. The filtering face mask of claim 50, wherein the valve cover is made of a sintered plastic that has been formed over a tool.

52. The filtering face mask of claim 42, wherein the exhale filter element is removable.

53. The filtering face mask of claim 42, wherein the exhale filter element is replaceable.

54. The filtering face mask of claim 42, wherein substantially all exhaled air passes through either the mask body or the exhale filter element.

55. The filtering face mask of claim 42, wherein the exhale filter element removes at least 95% of the challenge when tested in accordance with a Bacterial Filtration Efficiency Test.

56. The filtering face mask of claim 42, wherein the exhale filter element removes at least 97% of the challenge when tested in accordance with a Bacterial Filtration Efficiency Test.

57. The filtering face mask of claim 42, wherein the mask enables at least 50% of air that enters the interior gas space to pass through the exhale filter element when tested in accordance with a Percent Flow Through Valve Test at a flow rate of 42 liters per minute.

58. The filtering face mask of claim 42, wherein the mask enables at least 75% of air that enters the interior gas space to pass through the exhale filter element when tested in accordance with a Percent Flow Through Valve Test at a flow rate of 42 liters per minute.

59. The filtering face mask of claim 42, wherein the mask enables at least 90% of air that enters the interior gas space to pass through the exhale filter element when tested in accordance with a Percent Flow Through valve Test at a flow rate of 79 liters per minute.

60. The filtering face mask of claim 42, wherein the mask is able to pass a Fluid Resistance Test.

61. The filtering face mask of claim 42, wherein the exhale filter element includes an additive that assists in inhibiting liquid penetration through the exhale filter element.

62. The filtering face mask of claim 42, wherein the exhale filter element includes a nonwoven fibrous web that contains a fluorochemical additive.

63. The filtering face mask of claim 42, wherein the exhale filter element includes fibers that have fluorine atoms located at a surface on the fibers.

64. The filtering face mask of claim 42, wherein the exhalation valve includes a flexible flap that lifts from a seal surface to place the valve in an open position in response to a force from an exhalation by a wearer, the exhale filter element being located downstream to the flexible flap.

65. The filtering face mask of claim 42, wherein the exhale filter element includes a nonwoven web that contains melt-blown microfibers.

66. The filtering face mask of claim 42, wherein the exhale filter element includes a nonwoven web that contains spunbonded polypropylene.

67. The filtering face mask of claim 42, wherein the exhale filter element includes an open-cell foam.

68. The filtering face mask of claim 42, wherein the exhale filter element includes a nonwoven web that contains thermally bonded fibers.

69. The filtering face mask of claim 42, wherein the exhale filtering element is associated with a shaping layer in the mask body.

70. The filtering face mask or claim 42, wherein the exhale filter element is molded into a three-dimensional structure.

71. The filtering face mask of claim 70, wherein the exhale filter element is molded into a structure that is configured to extend over an exhalation valve flap.

72. A filtering face mask that comprises:

(a) a mask body that includes a fibrous inhale filter element;

(b) an exhalation valve (i) that is disposed on the mask body, (ii) that has a valve seat and a flexible flap wherein the valve seat has a seal surface onto which the flap rests when closed and from which the flap lifts from and dynamically bends in response to an exhalation, and (iii) that has at least one orifice that allows exhaled air to pass from an interior gas space to an exterior gas space during the exhalation; and (c) an exhale filter element that does not also serve as the inhale filter element and that is disposed in the face mask's exhale flow stream to prevent contaminants from passing from the interior gas space to the exterior gas space with the exhaled air.

* * * * *

UNITED STATES PATENT AND TRADEMARK OFFICE

CERTIFICATE OF CORRECTION

PATENT NO. : 6,805,124 B2
DATED : October 19, 2004
INVENTOR(S) : Japuntich, Daniel A.

It is certified that error appears in the above-identified patent and that said Letters Patent is hereby corrected as shown below:

Title page,
Item [56], References Cited, OTHER PUBLICATIONS, "Friedrichs, Jr. W.H.," reference, delete "Masks" and insert -- Mask --, therefore.

Column 1,
Line 51, delete "Bums" and insert -- Burns --, therefore.

Column 8,
Line 60, after "are" delete ",".

Column 18,
Line 59, after "exhalation" delete "valve can".

Column 20,
Line 57, delete "much" and insert -- such --, therefore.

Column 21,
Line 4, delete "or" and insert -- of --, therefore.

Column 22,
Line 44, delete "or" and insert -- of --, therefore.

Signed and Sealed this

Twenty-second Day of February, 2005

JON W. DUDAS
*Director of the United States Patent and Trademark Office*